US005698505A

United States Patent [19]

Ofosu-Asante

[11] Patent Number: 5,698,505

[45] Date of Patent: Dec. 16, 1997

[54] HIGH SUDSING LIGHT DUTY LIQUID OR GEL DISHWASHING DETERGENT COMPOSITIONS CONTAINING LONG CHAIN AMINE OXIDE

[75] Inventor: Kofi Ofosu-Asante, Cincinnati, Ohio

[73] Assignee: The Procter & Gamble Company, Cincinnati, Ohio

[21] Appl. No.: 814,151

[22] Filed: Mar. 10, 1997

Related U.S. Application Data

[63] Continuation of Ser. No. 466,947, Jun. 6, 1995, abandoned, which is a continuation of Ser. No. 187,254, Jan. 25, 1994, abandoned.

[51] Int. Cl.[6] ..... C11D 1/83; C11D 3/386

[52] U.S. Cl. ..... 510/221; 510/226; 510/228; 510/427; 510/497; 510/502; 510/503

[58] Field of Search ..... 510/221, 226, 510/228, 427, 497, 502, 503

[56] References Cited

U.S. PATENT DOCUMENTS

| | | | |
|---|---|---|---|
| 3,844,951 | 10/1974 | Fries et al. | 252/8.6 |
| 3,898,186 | 8/1975 | Mermelstein et al. | 252/528 |
| 3,928,249 | 12/1975 | Nunziata et al. | 252/526 |
| 3,943,234 | 3/1976 | Roggenkamp | 424/343 |
| 4,005,025 | 1/1977 | Kinstedt | 252/89 R |
| 4,024,078 | 5/1977 | Gilbert et al. | 252/551 |
| 4,144,201 | 3/1979 | Winterbotham et al. | 252/547 |
| 4,259,217 | 3/1981 | Murphy | 252/547 |
| 4,316,824 | 2/1982 | Pancheri | 252/551 |
| 4,435,317 | 3/1984 | Gerritsen et al. | 252/547 |
| 4,561,998 | 12/1985 | Wertz et al. | 252/547 |
| 4,906,396 | 3/1990 | Falholt et al. | 252/174.12 |
| 5,160,658 | 11/1992 | Smith et al. | 252/174.19 |
| 5,164,117 | 11/1992 | Sauer et al. | 252/355 |
| 5,174,927 | 12/1992 | Honsa | 252/543 |
| 5,230,823 | 7/1993 | Wise et al. | 252/174.21 |
| 5,238,609 | 8/1993 | Smith et al. | 252/547 |
| 5,244,593 | 9/1993 | Roselle et al. | 252/99 |
| 5,269,974 | 12/1993 | Ofosu-Asante | 252/544 |
| 5,332,528 | 7/1994 | Pan et al. | 252/548 |
| 5,376,310 | 12/1994 | Cripe et al. | 252/548 |
| 5,378,409 | 1/1995 | Ofosu-Asante | 252/548 |
| 5,415,814 | 5/1995 | Ofosu-Asante et al. | 510/235 |
| 5,417,893 | 5/1995 | Ofosu-Asante | 510/235 |
| 5,422,030 | 6/1995 | Pananpiker et al. | 252/135 |
| 5,474,710 | 12/1995 | Ofosu-Asante et al. | 510/537 |
| 5,545,354 | 8/1996 | Ofosu-Asante | 510/237 |

FOREIGN PATENT DOCUMENTS

| | | | |
|---|---|---|---|
| 0 232 153 A3 | 8/1987 | European Pat. Off. | C11D 1/86 |
| 0314232 | 5/1989 | European Pat. Off. . | |
| 1266200 | 10/1989 | Japan | C11D 17/08 |
| 2 205 578 | 12/1988 | United Kingdom | C11D 1/86 |
| 2 219 594 | 12/1989 | United Kingdom | C11D 1/94 |
| 2 234 983 | 2/1991 | United Kingdom | C11D 1/83 |
| 9206171 | 4/1992 | WIPO . | |
| WO 92/06161 | 4/1992 | WIPO | C11D 1/86 |
| 9305132 | 3/1993 | WIPO . | |
| WO 94/05758 | 3/1994 | WIPO | C11D 1/83 |
| WO 95/07971 | 3/1995 | WIPO | C11D 3/386 |

*Primary Examiner*—Paul Lieberman
*Assistant Examiner*—Lorna M. Douyon
*Attorney, Agent, or Firm*—Mary Pat McMahon; George W. Allen

[57] ABSTRACT

Light duty liquid or gel dishwashing detergent compositions which exhibit good grease emulsification performance comprise detergent surfactants and high amounts of long chain amine oxide. A preferred embodiment additionally contains suds boosters and divalent ions.

6 Claims, No Drawings

HIGH SUDSING LIGHT DUTY LIQUID OR GEL DISHWASHING DETERGENT COMPOSITIONS CONTAINING LONG CHAIN AMINE OXIDE

This is a continuation of application Ser. No. 08/466,947, filed on Jun. 6, 1995, now abandoned; which is a continuation of application Ser. No. 08/187,254, filed on Jan. 25, 1994, now abandoned.

TECHNICAL FIELD

The present invention relates to liquid or gel dishwashing detergent compositions containing detergent surfactants and high levels of long chain amine oxides for high sudsing compositions with improved grease emulsification.

BACKGROUND OF THE INVENTION

Light-duty liquid or gel dishwashing detergent compositions are well known in the art. However, the removal of greasy food residues from dishware in hand dishwashing operations has become a particular challenge to the formulator. Modem dishwashing compositions are, in the main, formulated as aqueous liquids; accordingly, water-stable ingredients must be used. Moreover, such compositions come into prolonged contact with skin; therefore, they must be mild. Yet, mildness is difficult to achieve in an effective dishwashing product, since products which remove grease from dishware may also tend to remove the natural skin oils from the user's hands.

Various means are employed to enhance grease and oil removal performance of detergent compositions. Grease-cutting anionic surfactants have been employed, but some of these may be irritating to biological membranes. Attempts have been made to employ nonconventional detergent surfactants in liquid compositions. Indeed, while a review of the literature would seem to suggest that a wide selection of surfactants is available to the detergent manufacturer, the reality is that many such materials are specialty chemicals which are not suitable in low unit cost items such as home-use detergent compositions. The fact remains that most home-use detergents still comprise one or more of the conventional ethoxylated nonionic and sulfated or sulfonated anionic surfactants, presumably due to economic considerations.

The challenge to the detergent manufacturer seeking improved grease/oil removal has been increased by various environmental factors. For example, some nonbiodegradable ingredients have fallen into disfavor. Effective phosphate builders have been banned by legislation in many countries. Moreover, many surfactants are often available only from nonrenewable resources such as petrochemicals. Accordingly, the detergent formulator is quite limited in the selection of surfactants which are effective cleaners and high sudsers, biodegradable and, to the extent possible, available from renewable resources such as natural fats and oils, rather than petrochemicals.

Considerable attention has lately been directed to nonionic surfactants which can be prepared using mainly renewable resources, such as fatty esters and sugars. One such class of surfactants includes the polyhydroxy fatty acid amides. Moreover, the combination of such nonionic surfactants with alkyl sulfates, alkyl benzene sulfonates, alkyl ether sulfates, secondary soaps and the like has also been studied. The present invention undertakes to substantially improve the grease and oil removal properties of such compositions.

Succinctly stated, the invention herein is based on the unexpected discovery that use of long chain amine oxides in a particular ratio with detergent surfactants, can substantially enhance the grease and oil removal properties of detergent compositions, especially, but not limited to, anionic surfactants. While not intending to be limited by theory, it appears that inclusion of relatively high levels of such amine oxides into such compositions substantially enhances their ability to rapidly lower the interfacial tension of aqueous washing liquors with greasy and oil soils. This substantial reduction of interfacial tension leads to what might be termed "spontaneous emulsification" of greasy and oil soils, thereby speeding their removal from soiled surfaces and inhibiting the redeposition of the soils onto substrates. This phenomenon is particularly noteworthy in the case of hand dishwashing operations with greasy dishware.

It has further been determined that the use of long chain amine oxides do not provide optimum high sudsing, as is desired by the users of such compositions especially for hand dishwashing purposes. Indeed, short chain amine oxides and/or anionic surfactants are often conventionally used to increase suds levels in typical light duty liquid or gel dishwashing detergent compositions. The consumer tends to equate performance of dishwashing products with suds height and volume, and even uses the diminution of suds to signal the need for the addition of more product into the dishwash bath. Accordingly, the use of long chain amine oxides in such compositions is sub-optimal, inasmuch as sudsing can suffer.

By the present invention it has been determined that certain ratios of long chain amine oxides to detergent surfactant not only provide the desired lowering of interfacial tension, with its attendant increase in grease removal performance, but also allow the formulation of reasonably high sudsing liquid compositions which are stable and homogeneous. It has further been discovered that these special benefits can be achieved at a broad pH range, especially neutral pH which enhances mildness. The overall unexpected improvements in performance and aesthetic qualities, especially spontaneous grease emulsification and high sudsing, provide the basis for the present invention, which is described in more detail hereinafter.

SUMMARY OF THE INVENTION

The present invention relates to a high sudsing, spontaneous grease emulsifying, light-duty liquid or gel dishwashing detergent composition comprising by weight:

(a) from about 5% to about 99% of detergent surfactant selected from the group consisting of polyhydroxy fatty acid amides; nonionic fatty alkypolyglucosides; $C_{8-22}$ alkyl sulfates; $C_{9-15}$ alkyl benzene sulfonates, $C_{8-22}$ alkyl ether sulfates; $C_{8-22}$ olefin sulfonates; $C_{8-22}$ paraffin sulfates; $C_{8-22}$ alkyl glyceryl ether sulfonates; fatty acid ester sulfonates; secondary alcohol sulfates; ampholytic detergent surfactants; zwitterionic detergent surfactants; and mixtures thereof; and (b) from about 8.0% to about 20% $C_{10}$–$C_{22}$ amine oxide; said composition comprises a pH between about 6 to about 10, and a amine oxide to detergent surfactant ratio from about 2:1 to about 1:4.

A particularly preferred embodiment also comprises from about 1.09 to about 40% of a $C_{12}$ to $C_{16}$ amine oxide and 0.1% to about 4% divalent ions (i.e. magnesium and/or calcium).

DETAILED DESCRIPTION OF THE INVENTION

The light-duty liquid or gel dishwashing detergent compositions of the present invention contain two essential components:

(1) high sudsing detergent surfactants; and (2) high levels of $C_{10}$ to $C_{22}$ amine oxide.

Optional ingredients especially divalent ions can be added to provide various performance and aesthetic characteristics.

The term "light-duty dishwashing detergent composition" as used herein refers to those compositions which are employed in manual (i.e. hand) dishwashing.

Detergent Surfactant

The compositions of this invention contain from about 5% to about 99%, preferably from about 10% to about 70%, most preferably from about 20% to about 60% of detergent surfactant.

Included in this category are several anionic surfactants commonly used in liquid or gel dishwashing detergents. The cations associated with these anionic surfactants are preferably selected from the group consisting of calcium, sodium, potassium, magnesium, ammonium or alkanol-ammonium, and mixtures thereof, preferably sodium, ammonium, calcium and magnesium and/or mixtures thereof. Examples of anionic surfactants that are useful in the present invention are the following:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group, x is 1–30 an M's a mono- or divalent cation.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(8) Secondary alcohol sulfates having 6 to 18 carbon atoms, preferably 8 to 16 carbon atoms.

(9) Alkyl ethoxy carboxylates of the generic formula $RO(CH_2CH_2O)_xCH_2COO^-M^+$ wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation preferably chosen from alkali metal, ammonium, mono-, di-, and tri-ethanolammonium, most preferably from sodium, potassium, ammonium, and mixtures thereof. The preferred alkyl ethoxy carboxylates are those where R is a $C_{12}$ to $C_{14}$ alkyl group.

In each of the above formulas A, B, C and D, the species M can be any suitable, especially water-solubilizing, counterion, e.g., H, alkali metal, alkaline earth metal, ammonium, alkanolammonium, di- and tri-alkanolammonium, $C_1$–$C_5$ alkyl substituted ammonium and the like. Sodium is convenient, as is monoethanolammonium.

(10) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The compositions hereof may also contain a polyhydroxy fatty acid amide surfactant of the structural formula:

$$R^2—\overset{\overset{\displaystyle O}{\|}}{C}—\overset{\overset{\displaystyle R}{|}}{N}—Z$$

wherein: R is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$ where n is an integer from 3 to 5, inclusive, and R' is H or a cyclic or aliphatic monosaccharide, and akoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, pamitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, U.S. Pat. No. 1,985,424, issued Dec. 25, 1934 to Piggott, U.S. Pat. No. 5,188,769, Connor et at, issued Feb. 23, 1993 and U.S. Pat. No. 5,194,639, Connor et al, issued Mar. 16, 1993, each of which is incorporated herein by reference.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pat. No. 3,925,262, Laughlin et al, issued Dec. 9, 1975 and U.S. Pat. No. 3,929,262, Laughlin et al, issued Dec. 30, 1975, said patents being incorporated herein by reference.

Ampholytic surfactants include derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Long Chain Amine Oxide

The second essential ingredient, amine oxide semi-polar nonionic surfactants of the present invention comprise compounds and mixtures of compounds having the formula:

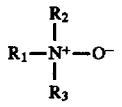

wherein $R_1$ is a $C_{10-22}$, preferably $C_{10-16}$ alkyl, and $R_2$ and $R_3$ are methyl or ethyl. The above amine oxides are more fully described in U.S. Pat. No. 4,316,824 (Pancheri), U.S. Pat. Nos. 5,075,501 and 5,071,594, incorporated herein by reference.

The present invention can contain from about 8% to about 30%, preferably from about 8% to about 25%, more preferably from about 9% to about 20% of the long chain amine oxide. In addition the long chain amine oxide are present at a ratio from about 2:1 to about 1:4, preferably from about 2:1 to about 1:3 of amine oxide to surfactant.

pH of the Composition

Dishwashing compositions of the invention will be subjected to acidic stresses created by food soils when put to use, i.e., diluted and applied to soiled dishes. If a composition with a pH greater than 7 is to be more effective in improving performance, it should contain a buffering agent capable of maintaining the alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH.

The buffering agent is present in the compositions of the invention hereof at a level of from about 0.1% to 15%, preferably from about 1% to 10%, most preferably from about 2% to 8%, by weight of the composition.

Calcium or Magnesium Ions

The presence of calcium and/or magnesium (divalent) ions improves the cleaning of greasy soils for various compositions, i.e. compositions containing alkyl ethoxy carboxylates and/or polyhydroxy fatty acid amide. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention hereof containing magnesium and/or calcium ions exhibit good grease removal, manifest mildness to the skin, and provide good storage stability. The ions are present in the compositions hereof at an active level of from about 0.1% to 4%, preferably from about 0.1% to 2%, more preferably from about 0.1% to 1%, by weight.

Preferably, the magnesium or calcium ions are added as a hydroxide, chloride, acetate, formate, oxide or nitrate salt to the compositions of the present invention.

The amount of calcium or magnesium ions present in compositions of the invention will be dependent upon the amount of total surfactant present therein, including the amount of alkyl ethoxy carboxylates and polyhydroxy fatty acid amide. When calcium ions are present in the compositions of this invention, the molar ratio of calcium ions to total anionic surfactant is from about 0.25:1 to about 2:1 for compositions of the invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed herein below may also be necessary.

Suds Boosters

Highly desirable components include from about 1% to about 10%, preferably from about 2% to about 8% of suds boosters such as betaines, ethylene oxide condensates, fatty acid amides, sultaines, complex betaines and cationic surfactants.

The composition of this invention can contain betaine detergent surfactants having the general formula:

$$R-\overset{(+)}{N}(R^1)_2-R^2COO^{(-)}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1-CO-N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dedecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula:

$$R_1(C_2H_4O)_nN^+(R_2)(R_3)\cdots O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 12 carbon atoms, $R_2$ and $R_3$ are propyl, isopropyl, 2-hydroxyethyl, 2-hydroxypropyl, or 3-hydroxypropyl, and n is from 0 to about 10.

The above ethylene oxide condensates, amides, and amine oxides are more fully described in U.S. Pat. No. 4,316,824 (Pancheri), incorporated herein by reference.

The sultaines useful in the present invention are those compounds having the formula $(R(R^1)_2N^+R^2SO_3-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group preferably a $C_1$–$C_3$ alkylene or preferably hydroxyalkylene group. Examples of suitable sultaines include $C_{12}$–$C_{14}$ dimethylammonio-2-hydroxypropyl sulfonate sultaine, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonia-2-hydroxypropyl sultaine being preferred.

The complex betaines for use herein have the formula:

$$R-(A)_n-[N-(CHR_1)_x]_y-N-Q \quad (I)$$

(B attached to (A)$_n$ and to the (CHR$_1$)$_x$ group)

wherein R is a hydrocarbon group having from 7 to 22 carbon atoms, A is the group (C(O), n is 0 or 1, $R_1$ is hydrogen or a lower alkyl group, x is 2 or 3, y is an integer of 0 to 4, Q is the group $-R_2COOM$ wherein $R^2$ is an alkylene group having from 1 to 6 carbon atoms and M is hydrogen or an ion from the groups alkali metals, alkaline earth metals, ammonium and substituted ammonium and B is hydrogen or a group Q as defined.

An example of this category is alkylamphopolycarboxy glycinate of the formula:

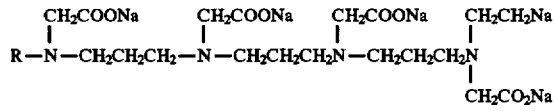

The composition of this invention can also contain certain cationic quaternary ammonium surfactants of the formula:

$$[R^1(OR^2)][R^3(OR^2)]_2R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $-CH_2CH_2-$, $-CH_2CH(CH_3)-$, $-CH_2CH(CH_2OH)$, $-CH_2CH_2CH_2-$, and mixtures thereof, each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactant described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

Other Optional Components

In addition to the essential ingredients described hereinbefore, the compositions contain other conventional ingredients, especially those associated with dishwashing compositions.

The compositions can also contain from about 0.01% to about 15%, preferably from about 1% to about 10%, by weight nonionic detergent surfactants. Suitable nonionic detergents are disclosed in U.S. Pat. No. 4,321,165, Smith et al (Mar. 23, 1982) U.S. Pat. No. 4,316,824 Pancheri (Feb. 234, 1982) and U.S. Pat. No. 3,929,678, Laughlin et al., (Dec. 30, 1975). Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from about 10 to about 20 carbon atoms with from about 2 to about 10 moles of ethylene oxide per mole of alcohol.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility.

4. The condensation products of ethylene oxide with the product resulting from the reaction of propylene oxide and ethylenediamine.

5. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. U.S. Pat. Nos. 4,373,203 and 4,732,704, incorporated herein by reference, also describe acceptable surfactants.

Other conventional optional ingredients which are usually used in additive levels of below about 5% include opacifiers, antioxidants, bactericides, dyes, perfumes, optical brighteners, and the like.

Optional enzymes such as lipase and/or amylase may be added to the compositions of the present invention for additional cleaning benefits.

Detergency builders can also be present in amounts from 0% to about 50%, preferably from about 2% to about 30%, most preferably from about 5% to about 15%. It is typical in light duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis(2-ethanol)blycine), citrate N-(2-hydroxylethyl) iminodiacetic acid (HIDA), N-(2,3-dihydroxy-propyl) iminodiacetic acid (GIDA), and their alkali metal salts. Some of these chelating agents are also identified in the art as detergency builders.

The compositions of this invention may contain for chelating and detergency purposes from about 0.001% to about 15% of certain alkylpolyethoxypolycarboxlyate surfactants of the general formula $$R-(O)-(\underset{R_1}{CH}-\underset{R_2}{CH}-O)_x-R_3$$

wherein R is a $C_6$ to $C^{18}$ alkyl group, x ranges from about 1 to about 24, $R_1$ and $R_2$ are selected from the group consisting of hydrogen, methyl acid radical succinic acid radical hydroxy succinic acid radical, and mixtures thereof, wherein at least one $R_1$ or $R_2$ is a succinic acid and/or hydroxysuccinic acid radical and $R_3$ is H. An example of a commercially available alkylpolyethoxypoly-carboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is desirable.

Other desirable ingredients include diluents and solvents. Diluents can be inorganic salts, such as sodium sulfate, sodium chloride, sodium bicarbonate, etc., and the solvents include water, lower molecular weight alcohols such as ethyl alcohol, isopropyl alcohol, etc. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, conventional hydrotropes, etc.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgment of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 80% by weight, preferably from about 25% to about 65% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application- will be dependent upon factors such as the degree of soiling of the dish. The contacting of the absorbing device to the dish surface is preferably accompanied by concurrent scrubbing.

GREASE REMOVAL AND SUDSING

The spontaneous emulsification" of greasy/oily soils provided by the compositions herein can be simply, but convincingly, demonstrated by admixing a detergent composition in accordance with the invention containing the specially selected soap with water. After dissolution of the detergent, a few drops of oil to which a colored oil-soluble dye has been added are added to the detergent solution. With minimal agitation, the entire system appears to take on the color of the dye, due to the dyed oil having been finely dispersed by the spontaneous emulsification effect. This dispersion remains for a considerable length of time, typically 30 minutes to several hours, even when agitation has stopped. By contrast, with surfactant systems which fail to provide spontaneous emulsification, the dyed oil droplets produced during agitation rapidly coalesce to form one or more relatively large oil globules at the air/water interface.

More specifically, this demonstration of spontaneous emulsification can be run as follows.

A consumer relevant test soil is dyed with 0.5% Oil Red EGN. A 100 ml sample of the detergent composition being tested is prepared at the desired concentration (typically, about 500 ppm) and temperature in water which is "prehardened" to any desired concentration of calcium ions (typically, about 48 ppm), and contained in an 8 oz. capped jar. The sample pH is adjusted to the intended end-use pH (typically in the range of 6.5 to 8) and 0.2 g of the test soil is added. The jar is shaken 4 times and the sample graded. Alternatively, the sample is placed in a beaker and stirred with a stir bar for 15 seconds. The sample is graded as follows:

0=Clear solution with large red oil droplets in it (0.1–5 mm diameter), i.e., no emulsification;

1=Solution has a definite pink appearance with red oil droplets in it (0.1–1 mm), i.e., slight emulsification;
2=Solution is dark pink with small red droplets in it, i.e., moderate emulsification;
3=Solution is red with small red droplets in it (1–200gin), i.e. emulsification is substantial;
4=Solution is dark red with little or no visible droplets (<1–50 μm), i.e., emulsification is complete.
Note: The grading can be done spectrophotometrically (based on light transmittance).

An alternate method for assessing grease removal performance is a determination of the amount of solid animal fat removed from polypropylene cups (PPC) under soil situation. Between 3 and 8 grams of animal fat is solidified onto the bottom of PPCs and from about 0.2 to about 4% of the product is added. The % of fat removed after about 4 hours of storage is a gauge for the grease cleaning efficiency of the composition.

A tumbling tube sudsing method is a means for measuring sudsing of a product. The test comprises preparing 0.12% solution of a composition in water of varying hardness (2, 21 grains per gallon, GPG) and place it in a cylinder. The composition is rotated for a minute, at which time a soil addition is made. This cycle is continued until the suds height reaches 3/10 of an inch.

As used herein, all percentages, parts, and ratios are by weight unless otherwise stated. The following Examples illustrate the invention and facilitate its understanding.

EXAMPLE I

Light duty liquid dishwashing detergent formulae are as follows:

TABLE 1

| Ingredient | % by Weight Compostion A | B | C |
|---|---|---|---|
| Sodium $C_{12-13}$ alkyl ethoxy (1) sulfate | 28.5 | 0 | 0 |
| Sodium $C_{12-13}$ alkyl ethoxy (1–3) sulfate | | 13 | 16 |
| $C_{12}$ Glucose amide | 0 | 5 | 0 |
| $C_{12-13}$ amine oxide | 2.61 | 14 | 14 |
| Ethanol | 4.000 | 5.500 | 5.500 |
| Neodol ® $C_{11}E_9$[1] | 3.000 | 5.000 | 5.000 |
| Sodium diethylene penta acetate (40%) | 0.030 | 0.030 | 0.030 |
| Perfume | 0.090 | 0.090 | 0.090 |
| Magnesium++ (added as chloride) | 0.83 | 0.60 | 0.60 |
| Water and minors | | Balance | |
| pH @ 10% (As made) | 7.100 | 8.000 | 8.100 |

[1]Nonionic surfactant from Shell

TABLE 2

| | A | B | C |
|---|---|---|---|
| Avg. Sudsing* | | | |
| 2 gpg | 100 | 126 | 117 |
| 21 gpg | 100 | 111 | 105 |
| *Tumbling tube method | | | |
| Grease Removal | | | |
| 2 gpg | 100 | 134 | 122 |
| 21 gpg | 100 | 141 | 136 |
| SEG 7 gpg | | | |

Compositions B and C are high sudsing and very good grease cleaning compositions. More importantly, Compositions B and C upon contact with greasy spoil spontaneously emulsify the grease. The control (Composition) A does not give the same benefit.

EXAMPLE II

Light duty liquid dishwashing detergent compositions are as follows:

TABLE 3

| Ingredients | D | E | F | G |
|---|---|---|---|---|
| Diethylenetriamine penta acetate | 0.06 | 0.06 | 0.06 | 0.06 |
| Ethanol | 4.5 | 4.5 | 4.5 | 4.5 |
| Magnesium chloride | 2.18 | 2.18 | 2.18 | 2.18 |
| Sucrose | 1.50 | 1.50 | 1.50 | 1.50 |
| Alkyl ethoxy$_{(2.2)}$ sulfate | 13.00 | 15.00 | 16.00 | 17.00 |
| Sodium hydroxide | 1.13 | 1.13 | 1.13 | 1.13 |
| Polyhydroxy fatty acid amide | 5.30 | 5.00 | 0 | 0 |
| $C_{12-13}$ Amine oxide | 14.00 | 14.00 | 12.00 | 12.00 |
| Alkyldimethyl Neodol $C_{11}E_9$ | 3.00 | 3.00 | 5.00 | 6.00 |
| Perfume | 0.23 | 0.23 | 0.23 | 0.23 |
| Calcium formate | 0.53 | 0.53 | 1.14 | 1.14 |
| Protease B | 0.05 | 0.08 | 0.05 | 0.08 |
| Water | | Balance | | |

EXAMPLE III

Light duty liquid dishwashing detergent compositions are as follows:

TABLE 4

| Ingredients | H | I | J | K | L |
|---|---|---|---|---|---|
| Alkylethoxy (1.0) sulfate | 28.500 | 0 | 0 | 0 | 0 |
| Alkylethoxy (2.2) sulfate | 0 | 20 | 19 | 20 | 19 |
| $C_{12-13}$ Amine oxide | 2.61 | 11 | 11 | 11 | 11 |
| Neodol ® $C_{11}E_9$[1] | 0 | 4 | 4 | 0 | 0 |
| $C^{12}$ Glucose amide | 0 | 0 | 0 | 4 | 4 |
| Alkyldimethyl betaine | 0.87[2] | 0 | 1 | 0 | 1 |
| Sodium diethylene penta acetate (40%) | 0.03 | 0.03 | 0.03 | 0.03 | 0.03 |
| Mg++ (added as chloride) | 0.83 | 0.6 | 0.6 | 0.6 | 0.6 |
| Ethanol | 4.0 | 4.5 | 4.5 | 4.5 | 4.5 |
| Perfume | 0.18 | 0.18 | 0.18 | 0.18 | 0.18 |
| Water and minor | | | balance | | |

[1]Nonionic from Shell
[2]Betaine/tetronic 704 ®

TABLE 5

| | H | I | J | K | L |
|---|---|---|---|---|---|
| Avg. Sudsing[11] | | | | | |
| 2 gpg | 100 | 114 | 114 | 128 | 117 |
| 21 gpg | 100 | 117 | 118 | 124 | 121 |
| [1]From tumbling tube sudsing method | | | | | |
| Grease removal | | | | | |
| 0.5 gpg | 100 | 131 | 134 | 143 | 118 |
| 21 gpg | 100 | 133 | 127 | 140 | 135 |
| SEG 7 gpg | 0 | 4 | 4 | 4 | 4 |

I-L composition suds and clean much better than the control H.

EXAMPLE IV

Concentrated light duty liquid dishwashing detergent compositions are as follows:

TABLE 6

| | M | N | O | P |
|---|---|---|---|---|
| Alkyl ethoxy (1.0) sulfate | 0 | 0 | 27 | 0 |
| Alkyl ethoxy (2.2) sulfate | 27 | 27 | 0 | 32 |
| $C_{12-13}$ Amine oxide | 18 | 18 | 18 | 18 |
| $C_{12}$ Glucose amide | 0 | 6 | 0 | 0 |
| Neodol ® $C_{11}E_9$ | 12 | 6 | 12 | 9 |
| $Mg^{++}$ (added as chloride) | 0.4 | 0.3 | 0.3 | 0.3 |
| Sodium xylene sulfonate | 4 | 4 | 4 | 4 |
| Ethanol | 8 | 8 | 8 | 8 |
| Perfume | 0.3 | 0.3 | 0.3 | 0.3 |
| Propanediol | 4 | 4 | 4 | 4 |
| Sodium diethylene penta acetate (40%) | 0.03 | 0.03 | 0.03 | 0.03 |
| Water and minors | | | balance | |

[1]Nonionic surfactant from Shell

What is claimed is:

1. A high sudsing, spontaneous grease emulsifying light-duty liquid or gel dishwashing detergent composition consisting essentially of weight:

a) from about 10% to about 70% of detergent surfactant consisting essentially of mixtures of i) at least about 4% of nonionic surfactants selected from the group consisting of polyhydroxy fatty acid amides; and ii) anionic surfactants selected from the group consisting of $C_{8-22}$ alkyl ether sulfates;

b) from about 8% to about 25% of a $C_{12}$ to $C_{16}$ amine oxide of the formula:

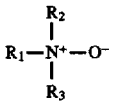

wherein R1 is a $C_{12-16}$ alkyl, and $R_2$ and $R_3$ are methyl or ethyl; in an amine oxide to said detergent surfactant ratio of from about 2:1 to about 1:3; and optionally:

c) from about 1% to about 10% suds booster;

d) from about 0.001% to about 5% of active enzyme; and e) from about 0.01% to about 4% magnesium of calcium ions or mixtures thereof.

2. The composition of claim 1 wherein the suds booster is present and is selected from the group consisting of betaines, ethylene oxide condensates, fatty acid amides, sultaines, complex betaines, cationic surfactants and mixtures thereof.

3. The composition of claim 2 wherein the pH is between about 6 and about 9.

4. The composition of claim 3 wherein said magnesium or calcium ions or mixtures thereof is present.

5. The composition of claim 4 wherein the magnesium or calcium ions are added as a salt selected from the group consisting of hydroxide, oxide, chloride, formate, acetate, and mixtures thereof.

6. The composition of claim 1 wherein the active enzyme is present.

* * * * *